United States Patent [19]

Frank

[11] 4,033,469

[45] * July 5, 1977

[54] FRONT END LOADER AND METHOD OF MOUNTING SAME ON TRACTOR

[75] Inventor: Eldon M. Frank, Lake View, Iowa

[73] Assignee: F & W Company, Inc., Lake View, Iowa

[ * ] Notice: The portion of the term of this patent subsequent to Feb. 24, 1993, has been disclaimed.

[22] Filed: Feb. 3, 1975

[21] Appl. No.: 546,432

Related U.S. Application Data

[63] Continuation-in-part of Ser. No. 260,465, June 7, 1972, Pat. No. 3,863,786.

[52] U.S. Cl. ..... 214/131 A; 172/272; 214/152

[51] Int. Cl.[2] ..... E02F 3/72

[58] Field of Search ..... 172/272, 275; 214/131 A, 145, 152

[56] References Cited

UNITED STATES PATENTS

| | | | |
|---|---|---|---|
| 3,043,375 | 7/1962 | Aström | 214/131 A |
| 3,324,954 | 6/1967 | Westendorf | 214/131 A |
| 3,939,997 | 2/1976 | Frank | 214/131 A |

FOREIGN PATENTS OR APPLICATIONS

| | | | |
|---|---|---|---|
| 833,368 | 2/1970 | Canada | 214/131 A |
| 1,924,269 | 11/1970 | Germany | 214/131 A |
| 1,248,551 | 8/1967 | Germany | 214/131 A |

OTHER PUBLICATIONS

"Triggs Farming Tools Catalog" pp. 7–9, printed Nov. 1, 1967.

*Primary Examiner*—Robert J. Spar
*Assistant Examiner*—Ross Weaver
*Attorney, Agent, or Firm*—Zarley, McKee, Thomte & Voorhees

[57] ABSTRACT

A tractor includes a quick attach and dismount front end loader. The tractor is provided with rearwardly positioned side-mounting brackets which are adapted to lockingly engage the lower ends of uprights on the loader. A transversely extending mounting bracket is provided across the front end of the tractor for engagement with a cross frame member on the loader. A stand engages the cross frame member for supporting the loader independently of the tractor. Hydraulic cylinders on the loader for raising and lowering the boom are operated for mounting and dismounting the loader. When the front mounting bracket engages the cross frame member on the loader contraction of the power cylinder causes the loader to pivot clockwise about an axis through the cross frame thereby bringing the uprights on the loader into engagement with the side mounting brackets on the tractor. Extension of the power cylinders causes the loader to pivot counterclockwise for dismounting the loader. The loader is supported only at and by the front and two side brackets.

18 Claims, 6 Drawing Figures

FRONT END LOADER AND METHOD OF MOUNTING SAME ON TRACTOR

This application is a continuation-in-part application of my co-pending application, Ser. No. 260,465, filed June 7, 1972, now U.S. Pat. No. 3,863,786 Implement Device And Method Of Mounting Same On Tractor.

The mounting brackets of my previous application included front and rear side brackets in addition to a front mounting bracket extending across the front end of the tractor. Pivotal movement of the loader occurred about an axis through the front side mounting brackets.

The mounting brackets of this invention are such that it is unnecessary to have the forward side mounting brackets since the pivotal axis is through the cross frame member of the loader which engages the front bracket across the front end of the tractor. Operation of the power cylinders cause the loader to pivot on and off the tractor.

The rear side mounting brackets now include upwardly extending guide plates which cooperate with a rearwardly positioned guide plate for guiding the lower end of the upright into the side mounting bracket on the tractor. The side plates include openings adapted to be aligned with openings through the upright to receive a locking bolt. The guide plates also include V-shaped notches to receive mating V-shaped elements on the uprights.

The mounting bracket across the front end of the tractor is U-shaped and faces downwardly with the rear wall of the bracket extending downwardly and rearwardly to guide the cross frame member into the bracket. A locking pin is also provided on the rear wall of the U-shaped bracket for extending into an opening in the cross frame member.

The invention consists in the construction, arrangements and combination of the various parts of the device, whereby the objects contemplated are attained as hereinafter more fully set forth, specifially pointed out in the claims, and illustrated in the accompanying drawings in which:

Figure 1:
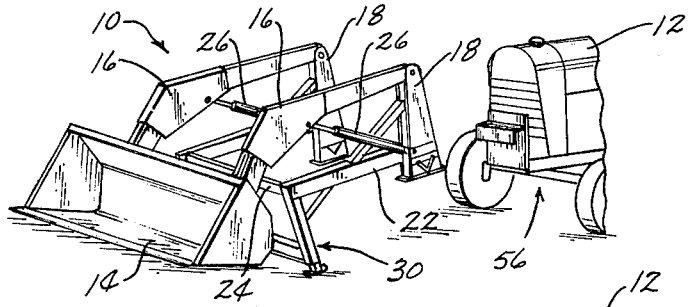
FIG. 1 is a fragmentary perspective view of the loader of this invention just prior to being mounted on a tractor.
Figure 4:
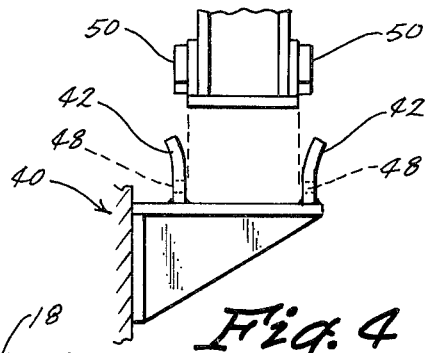
FIG. 4 is a cross sectional view taken along line 4—4 in FIG. 2.

The front end loader of this invention is referred to generally in FIG. 1 by the reference numeral 10 and is to be mounted on a tractor 12. The loader includes a bucket 14 connected to a boom having side members 16 pivotally connected to the upper ends of upright members 18. A U-shaped frame 20 has the rear ends of the side frame members 22 connected to the lower ends of the uprights 18 while the forward ends of the side frame members 22 are interconnected by a cross frame member 24. A pair of power cylinders 26 are provided on each side of the loader and extend between the boom side member 16 and the lower ends of the uprights 18.

A stand 30 is pivotally connected at 32 to forwardly extending extensions 34 of the side frame members 22 and is seen to pivot between two positions in which it is rigid with the side frame members. First is the downwardly extending supporting position of FIG. 2 and second is the upwardly extending position of FIG. 5.

The tractor 12 includes rearwardly disposed side mounting brackets 40 which include upwardly extending guide plate elements 42 which flare outwardly. Each of the plate elements include a V-shaped notch 44. A rearwardly disposed upwardly extending and rearwardly flaring stop guide plate 46 is provided between the plates 42. Openings 48 are porvided through the plates 42 and are adapted to align with opening 46 in the lower end of the uprights 18. A mating V-shaped element 50 is provided on each side of the uprights for engagement with the V-shaped notch 44 in the plates 42. A pair of pins 52 are held on the side of the uprights 18 when not in use and when in use are positioned in the openings 48 and 46.

The mounting bracket across the front end of the tractor is generally referred to by the reference numeral 56, as seen in FIG. 1. This bracket is U-shaped and faces downwardly having a forwardly positioned wall 58 and a rearwardly positioned wall 60 which is flared rearwardly to function as a guide for the cross frame member 24. A locking pin 62 is carried on the front mounting bracket and is spring loaded for extension into opening 64 in the cross frame.

Figure 2:
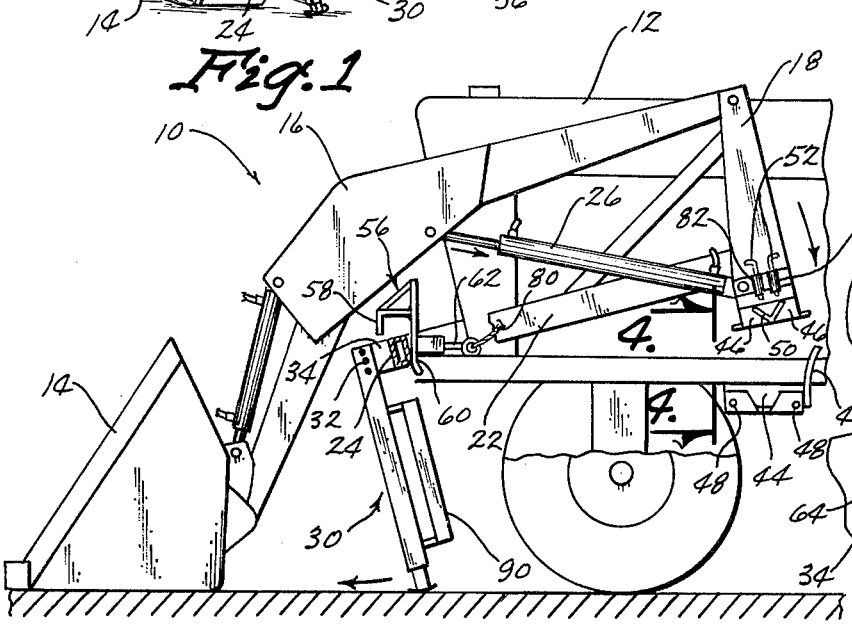
FIG. 2 is an enlarged fragmentary side elevation view of the loader with the tractor having been driven into position with the front mounting bracket on the tractor engaging the cross frame member on the loader.
Figure 3:
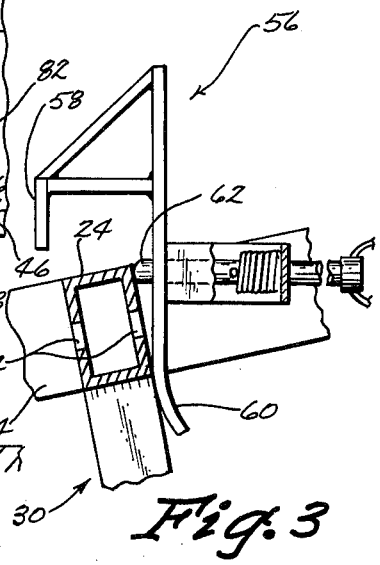
FIG. 3 is an enlarged cross sectional view similar to FIG. 2 but showing the front mounting bracket and cross frame member prior to the loader being pivoted onto the tractor.
Figure 5:
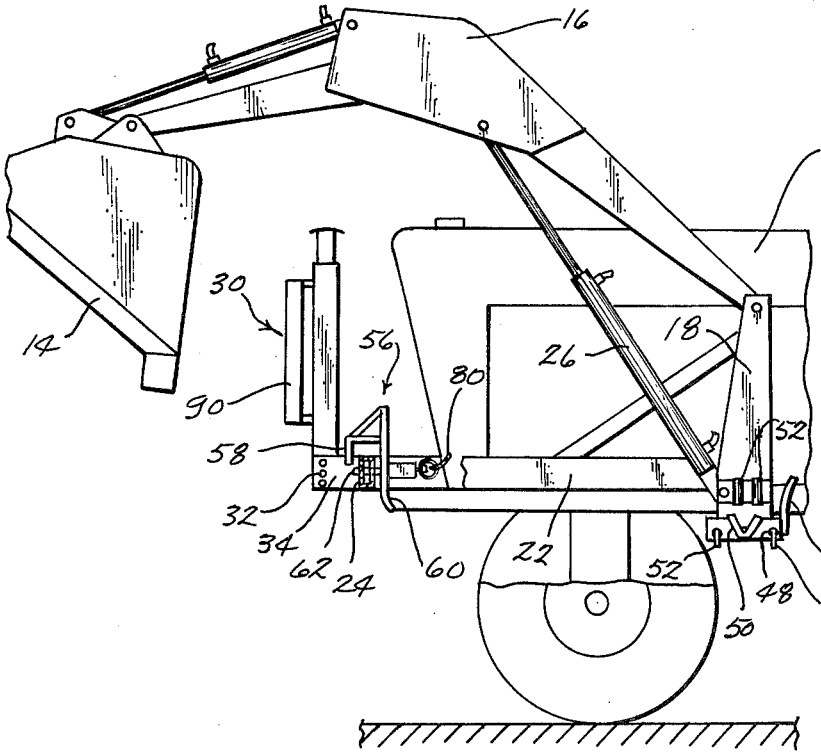
FIG. 5 is a view similar to FIG. 2 but showing the loader mounted on the tractor.
Figure 6:
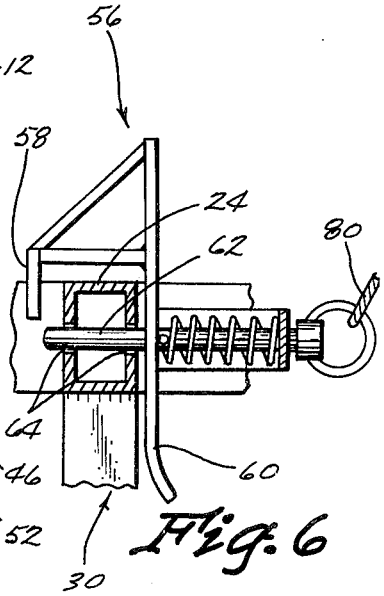
FIG. 6 is a cross sectional view similar to FIG. 3 showing the front mounting bracket and cross frame member after the loader is mounted on the tractor.

Thus it is seen in operation that the tractor 12 is driven into the loader 10 to the position of FIG. 2 where the front bracket 56 engages the cross frame 24. The hydraulic cylinders 26 are connected to the tractor. Next, the power cylinders 26 are contracted as indicated by the arrows in FIG. 2 causing the stand 30 to pivot forwardly while the loader pivots downwardly about an axis through the cross frame 24. As the rear end of the loader pivots downwardly the front end pivots upwardly slightly aligning the apertures 64 in the cross frame 20 with the pin 62 such that it automatically moves into locking engagement as seen in FIG. 6. The lower end of the uprights is now firmly in engagement with the side mounting brackets 40 and the pins 52 are positioned in the aligned openings 48 and 46, as seen in FIG. 5. The stand 30 may now be pivoted upwardly to its position of FIG. 5 since the loader is now supported by the front bracket 56 and the two side brackets 40. Removal of the loader is accomplished in a similar fashion with the steps being reversed. Specifically, the stand 30 would be pivoted downwardly and the pin 62 retracted by operation of the pull rope 80 which leads to the driver station now shown. The pins 52 are also removed and put in their holder 82, as seen in FIG. 2. The power cylinders 26 are now extended causing the loader to pivot counterclockwise on an axis through the cross frame 24 whereupon after the power cylinder hoses are disconnected the tractor may be driven away. Obviously, the bucket 14 on the loader is initially lowered into engagement with the ground to support the loader when the tractor is removed.

If desired, weights may be provided on the front end of the tractor by being placed in the holder 90 on the stand 30 which is pivoted upwardly when the loader is mounted on the tractor.

I claim:

1. Method of mounting a front end loader on a tractor, said loader having a U-shaped frame with opposite side frame members extending rearwardly from a cross frame member, uprights connected to the rear ends of the said side frame members and a boom having its rear end connected to the upper end of said uprights, power cylinders extending between the boom and the uprights; support brackets on opposite sides of said tractor for engagement with the lower ends of said uprights, a vertically disposed guide member on the front end of said tractor for engagement with the back side of said cross frame member, a downwardly extending support stand on the forward end of said U-shaped frame rigid therewith in that position, and locking means for detachably securing said cross frame member to said guide member, and said uprights to said support to said support brackets wherein said method includes the steps of, driving said tractor forward into said U-shaped frame on said rigid stand until said guide member engages said cross frame member, connecting the power cylinders to the power system on the tractor, operating said power cylinders such that they are contracted thereby causing said stand to pivot about an axis through the interface between said guide member and said cross frame member forwardly at its bottom end along the ground while said cross frame member remains horizontally stationary, and said uprights move into engagement with said support brackets, operating said power cylinders further to pivot said cross frame member upwardly about an axis through the interface between said uprights and said support brackets, and actuating said lock means for securing said cross frame member to said guide member and said uprights to said support brackets.

2. A tractor having a quick mount and dismount front end loader comprising, a front end loader having a U-shaped frame with opposite side frame members extending rearwardly from a forwardly positioned cross frame member having front and back sides, uprights connected to the rear ends of said side frame members and a boom having its rear end connected to the upper end of said uprights, power cylinders extending between the boom and the uprights, a tractor having side support brackets on opposite sides thereof for engagement with the lower ends of said uprights, a vertically disposed guide support bracket across the front endof said tractor for engagement with the back side of said cross frame member, said guide support bracket being U-shaped and open downwardly, a stand rigidly connected to the forward end of said U-shaped frame for pivotal movement therewith during the mounting and dismounting operations, locking means for detachably securing said cross frame member to said forward guide support bracket and said uprights to said side support brackets, said locking means including a pin carried on the U-shaped bracket for engagement with an opening in said cross frame, and the rear leg of said U-shaped bracket tapering downwardly and rearwardly for guiding said cross frame into and out of said U-shaped bracket, and said power cylinders upon being extended causing said loader to pivot counterclockwise about a pivotal axis through said cross frame member thereby disengaging said uprights from said support brackets when said associated lock means has been opened, and upon said power cylinders being contracted with said cross frame member engaging said guide member and said U-shaped frame extending rearwardly and upwardly said U-shaped frame will pivot clockwise downwardly about a transverse axis through said cross frame member whereby said uprights move into engagement with said support brackets.

3. The structure of claim 2 wherein said rear side support brackets each include upwardly extending spaced apart guide plates between which the lower ends of said uprights are received.

4. The structure of claim 3 wherein said guide plates are further defined as being laterally spaced apart to limit lateral movement of said uprights.

5. The structure of claim 3 wherein said guide plates each include a V-shaped notch which is adapted to receive V-shaped mating element on said associated upright.

6. The structure of claim 4 wherein each pair of said guide plates includes an upstanding stop guide plate at the rear thereof extending therebetween and having a rearwardly flared upper end for guiding said upright between said guide plates when said loader is pivoted onto said tractor.

7. The structure of claim 3 wherein said locking means includes on said uprights and said guide plates aligned openings when said uprights are in engagement with said support brackets and bolt means extend through said aligned openings.

8. In combination, an implement mountable on a tractor, comprising, an implement having a boom with a ground-engaging tool on the outer end and pivotally mounted to upright standards at its inner end carried on a U-shaped frame and power means interconnects said U-shaped frame and boom for relative pivotal movement therebetween, said U-shaped frame having a transversely extending member and a stand connected to said frame for cooperation with said tool for supporting said implement independently of said tractor, a tractor having oppositely disposed rear side support brackets for engagement with said standards, a vertically disposed guide-support bracket on said tractor forwardly of said side support brackets for engagement with said transversely extending member, and locking means for detachably securing said transversely extending member to said guide-support bracket and said uprights to said rear side support brackets whereby upon said transversely extending member engaging said guide support bracket and said power means being operated to pivot said U-shaped frame and boom towards each other said U-shaped frame pivots about an axis through said guide-support bracket until said standards engage said support brackets and then pivotal action occurs about an axis through said side support brackets to pivot said transversely extending member upwardly to a position for said locking means to lock said transversely extending member to said guide support bracket.

9. The structure of claim 8 wherein said guide-support bracket includes a vertically disposed portion positioned to engage the back side of said transversely extending member to limit rearward movement of said transversely extending member relative to said tractor during the pivoting of said U-shaped frame about said axis through said guide-support bracket.

10. The structure of claim 9 wherein said guide-support bracket is positioned across the front end of said tractor.

11. The structure of claim 9 wherein said guide-support bracket is U-shaped with front and rear legs and opens downwardly with said vertically disposed portion being said rear leg, and said locking means includes a pin carried on the U-shaped bracket for engagement with an opening in said cross frame, and the rear leg of the said U-shaped bracket tapers downwardly and rearwardly for guiding said cross frame into and out of the said U-shaped bracket.

12. The structure of claim 8 wherein said rear side support brackets each include upwardly extending spaced apart guide plates between which the lower ends of said uprights are received.

13. The structure of claim 12 wherein said guide plates are further defined as being laterally spaced apart to limit lateral movement of said uprights.

14. The structure of claim 12 wherein said guide plates each include a V-shaped notch which is adapted to receive V-shaped mating element on said associated upright.

15. The structure of claim 13 wherein each pair of said guide plates includes an upstanding stop guide plate at the rear thereof extending therebetween and having a rearwardly flared upper end for guiding said upright between said guide plates when said loader is pivoted onto said tractor.

16. The structure of claim 12 wherein said locking means includes on said uprights and said guide plates aligned openings when said uprights are in engagement with said support brackets and bolt means extend through said aligned openings.

17. The structure of claim 8 wherein said forward guide-support bracket is U-shaped and open downwardly and said locking means includes a pin carried on the U-shaped bracket for engagement with an opening in said cross frame, and the rear leg of said U-shaped bracket tapers downwardly and rearwardly for guiding said cross frame into and out of said U-shaped bracket.

18. The method of mounting an implement on a tractor wherein the implement includes a ground-engaging tool carried on a boom pivotally connected to upright standards on a U-shaped fram having a support stand for supporting said implement in cooperation with said tool independent of said tractor, and said tractor including a vertically disposed forward support-guide member and rearwardly positioned support brackets on opposite sides there-of wherein said method includes the steps of, driving the tractor forwardly until a transversely extending portion on the U-shaped frame is positioned against the vertically disposed guide member, operating the power means to pivot the boom and said U-shaped frame towards each other about an axis through said vertically disposed forward support-guide member and until the upright standards engage said support brackets, operating said power means further to pivot said transversely extending portion upwardly about an axis through said support brackets until said transversely extending portion is in a position to be locked to said vertically disposed forward support-guide member, and actuating said lock means for securing said transversely extending portion to said forward support-guide member and said uprights to said support brackets.

* * * * *